US010039312B2

(12) United States Patent
Marshall et al.

(10) Patent No.: US 10,039,312 B2
(45) Date of Patent: Aug. 7, 2018

(54) TOBACCO PRODUCTS AND PROCESSES

(71) Applicant: R.J. Reynolds Tobacco Company, Winston-Salem, NC (US)

(72) Inventors: Jerry Wayne Marshall, Stokesdale, NC (US); Susan Marlene Adams, Pine Hall, NC (US); Darlene Madeline Lawson, Kernersville, NC (US); Michael Francis Dube, Winston-Salem, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 1127 days.

(21) Appl. No.: 13/940,925

(22) Filed: Jul. 12, 2013

(65) Prior Publication Data

US 2015/0013694 A1 Jan. 15, 2015
US 2015/0313276 A9 Nov. 5, 2015

Related U.S. Application Data

(60) Continuation of application No. 13/491,319, filed on Jun. 7, 2012, which is a division of application No. 12/267,061, filed on Nov. 7, 2008.

(51) Int. Cl.

*A24B 15/42* (2006.01)
*A24B 15/30* (2006.01)
*A24B 15/28* (2006.01)

(52) U.S. Cl.

CPC ..... *A24B 15/42* (2013.01); *A24B 15/28* (2013.01); *A24B 15/30* (2013.01); *A24B 15/302* (2013.01)

(58) Field of Classification Search
None
See application file for complete search history.

(56) References Cited

U.S. PATENT DOCUMENTS

| | | | |
|---|---|---|---|
| 214,639 | A | 4/1879 | Emery |
| 1,376,586 | A | 5/1921 | Schwartz |
| 1,888,173 | A | 11/1932 | Jordan |
| 2,758,603 | A | 8/1956 | Heljo |
| 3,067,068 | A | 12/1962 | Finberg |
| 3,166,078 | A | 1/1965 | Parmele et al. |

(Continued)

FOREIGN PATENT DOCUMENTS

| | | | |
|---|---|---|---|
| CN | 1077358 | A | 10/1993 |
| CN | 101 292 776 | A | 10/2008 |

(Continued)

OTHER PUBLICATIONS

Massie, Thomas, "Salt—Its Use Recommended in Curing Tobacco" 1850, "The Plough the Loom and the Anvil", vol. II, J.S. Skinner, Philadelphia, pp. 700-701 (https://books.google.com/books?id=CFxTAAAAYAAJ).*

(Continued)

*Primary Examiner* — Michael J Felton
(74) *Attorney, Agent, or Firm* — Brinks Gilson & Lione

(57) ABSTRACT

A method of curing tobacco. The method comprises the steps of contacting a tobacco material with a curing additive comprising one or more salts and curing the tobacco material under conditions and temperature for a time sufficient to produce cured tobacco wherein the amount of the one or more salts contacted with the tobacco is at least 5 percent of the dry weight of the cured tobacco.

21 Claims, 2 Drawing Sheets

(56) References Cited

U.S. PATENT DOCUMENTS

| | | | | |
|---|---|---|---|---|
| 3,209,763 | A | 10/1965 | Parmele et al. | |
| 3,409,026 | A | 11/1968 | Hind et al. | |
| 3,681,087 | A | 8/1972 | Johnson, Jr. | |
| 3,845,217 | A | 10/1974 | Ferno et al. | |
| 3,845,417 | A | 10/1974 | Zaleski | |
| 3,849,555 | A | 11/1974 | Harvey | |
| 3,920,849 | A | 11/1975 | Marmo et al. | |
| 4,044,120 | A | 8/1977 | Rowsell et al. | |
| 4,070,496 | A | 1/1978 | Rowsell et al. | |
| 4,128,101 | A | 12/1978 | Kulka et al. | |
| 4,267,847 | A | 5/1981 | Reid | |
| 4,513,756 | A | 4/1985 | Pittman et al. | |
| 4,528,993 | A | 7/1985 | Sensabaugh, Jr. et al. | |
| 4,607,479 | A | 8/1986 | Linden | |
| 4,624,269 | A | 11/1986 | Story et al. | |
| 4,631,899 | A | 12/1986 | Nielsen | |
| 4,639,368 | A | 1/1987 | Niazi et al. | |
| 4,660,577 | A | 4/1987 | Sensabaugh et al. | |
| 4,694,842 | A | 9/1987 | Kobayashi | |
| 4,705,165 | A | 11/1987 | Thieke | |
| 4,802,498 | A | 2/1989 | Ogren | |
| 4,804,101 | A | 2/1989 | Heath | |
| 4,821,749 | A | 4/1989 | Toft et al. | |
| 4,832,059 | A | 5/1989 | Garrard et al. | |
| 4,848,373 | A | 7/1989 | Lenkey | |
| 4,987,907 | A | 1/1991 | Townend | |
| 5,092,352 | A | 3/1992 | Sprinkle, III et al. | |
| 5,099,864 | A | 3/1992 | Young et al. | |
| 5,167,244 | A | 12/1992 | Kjerstad | |
| 5,178,878 | A | 1/1993 | Wehling et al. | |
| D335,934 | S | 5/1993 | Howard | |
| 5,339,838 | A | 8/1994 | Young et al. | |
| 5,343,879 | A | 9/1994 | Teague | |
| 5,346,734 | A | 9/1994 | Wydick, Jr. | |
| 5,387,416 | A | 2/1995 | White et al. | |
| D368,221 | S | 3/1996 | Montague | |
| 5,501,237 | A | 3/1996 | Young et al. | |
| 5,584,306 | A | 12/1996 | Beauman et al. | |
| 5,676,164 | A * | 10/1997 | Martin | A24B 3/04 131/290 |
| 5,752,529 | A | 5/1998 | Mane et al. | |
| 5,886,155 | A | 3/1999 | Armah et al. | |
| 5,965,625 | A | 10/1999 | King | |
| 6,138,683 | A | 10/2000 | Hersh et al. | |
| 6,162,516 | A | 12/2000 | Derr | |
| 6,668,839 | B2 | 12/2003 | Williams | |
| 6,730,832 | B1 | 5/2004 | Dominguez et al. | |
| 6,755,200 | B1 | 6/2004 | Hempfling et al. | |
| 6,773,716 | B2 | 8/2004 | Ream et al. | |
| 6,834,654 | B2 | 12/2004 | Williams | |
| 6,845,777 | B2 | 1/2005 | Pera | |
| 6,895,974 | B2 | 5/2005 | Peele | |
| 6,953,040 | B2 | 10/2005 | Atchley et al. | |
| 7,025,066 | B2 | 4/2006 | Lawson et al. | |
| 7,304,207 | B2 | 12/2007 | Connors et al. | |
| D594,154 | S | 6/2009 | Patel et al. | |
| D630,525 | S | 1/2011 | Patel et al. | |
| 2002/0074009 | A1 | 6/2002 | Zhao et al. | |
| 2002/0170567 | A1 | 11/2002 | Rizzotto et al. | |
| 2004/0048532 | A1 | 3/2004 | Tharreau | |
| 2004/0118422 | A1 | 6/2004 | Lundin et al. | |
| 2005/0061339 | A1 | 3/2005 | Hansson et al. | |
| 2005/0115580 | A1 | 6/2005 | Quinter et al. | |
| 2005/0121046 | A1* | 6/2005 | Hempfling | A24B 15/183 131/347 |
| 2005/0155615 | A1 | 7/2005 | Rohdewald et al. | |
| 2005/0244521 | A1 | 11/2005 | Strickland et al. | |
| 2006/0162732 | A1 | 7/2006 | Winn et al. | |
| 2006/0185686 | A1 | 8/2006 | Lawrence, Jr. | |
| 2006/0191548 | A1 | 8/2006 | Strickland et al. | |
| 2006/0242735 | A1 | 10/2006 | Fader et al. | |
| 2007/0062549 | A1 | 3/2007 | Holton, Jr. et al. | |
| 2007/0186941 | A1 | 8/2007 | Holton, Jr. et al. | |
| 2007/0261707 | A1 | 11/2007 | Winterson et al. | |
| 2008/0011311 | A1 | 1/2008 | Ojima et al. | |
| 2008/0029110 | A1 | 2/2008 | Dube et al. | |
| 2008/0029116 | A1 | 2/2008 | Robinson et al. | |
| 2008/0029117 | A1 | 2/2008 | Mua et al. | |
| 2008/0029118 | A1 | 2/2008 | Nelson et al. | |
| 2008/0156338 | A1 | 7/2008 | Winterson et al. | |
| 2008/0166395 | A1 | 7/2008 | Roush | |
| 2008/0173317 | A1 | 7/2008 | Robinson et al. | |
| 2008/0202536 | A1 | 8/2008 | Torrence et al. | |
| 2009/0025738 | A1 | 1/2009 | Mua et al. | |
| 2009/0301505 | A1 | 12/2009 | Liu et al. | |
| 2010/0018539 | A1 | 1/2010 | Brinkley et al. | |
| 2010/0065075 | A1 | 3/2010 | Banerjee et al. | |
| 2010/0074850 | A1 | 3/2010 | De Klerk et al. | |
| 2010/0087524 | A1 | 4/2010 | Haiber et al. | |
| 2010/0206317 | A1 | 8/2010 | Albino et al. | |

FOREIGN PATENT DOCUMENTS

| | | | |
|---|---|---|---|
| EP | 514 805 | A2 | 11/1992 |
| EP | 1 222 865 | A1 | 7/2002 |
| FR | 664550 | | 9/1929 |
| JP | 57-6902 | B | 2/1982 |
| JP | 57-43232 | B | 9/1982 |
| JP | 11-243938 | A | 9/1999 |
| JP | 2002238536 | A | 8/2002 |
| WO | WO 96/14763 | A1 | 5/1996 |
| WO | WO 97/06786 | A1 | 2/1997 |
| WO | WO 99/00106 | A1 | 1/1999 |
| WO | WO 99/039595 | A1 | 8/1999 |
| WO | WO 00/025612 | A1 | 5/2000 |
| WO | WO 01/28370 | A1 | 4/2001 |
| WO | WO 02/01974 | A1 | 1/2002 |
| WO | WO 02/080707 | A1 | 10/2002 |
| WO | WO 02/091866 | A1 | 11/2002 |
| WO | WO 03/028491 | A1 | 4/2003 |
| WO | WO 03/053175 | A2 | 7/2003 |
| WO | WO 03/055337 | A1 | 7/2003 |
| WO | WO 04/095959 | A1 | 11/2004 |
| WO | WO 05/013734 | | 2/2005 |
| WO | WO 05/041699 | A2 | 5/2005 |
| WO | WO 05/046363 | A2 | 5/2005 |
| WO | WO 05/063060 | A1 | 7/2005 |
| WO | WO 06/004480 | A1 | 1/2006 |
| WO | WO 06/065192 | A1 | 6/2006 |
| WO | WO 06/120570 | A2 | 11/2006 |
| WO | WO 06/127772 | A2 | 11/2006 |
| WO | WO 07/037962 | A1 | 4/2007 |
| WO | WO 07/089613 | A2 | 8/2007 |
| WO | WO 07/138484 | A2 | 12/2007 |
| WO | WO 08/016520 | A2 | 2/2008 |
| WO | WO 08/056135 | A2 | 5/2008 |
| WO | WO 08/066450 | A1 | 6/2008 |
| WO | WO 08/066451 | A1 | 6/2008 |
| WO | WO 08/104891 | A2 | 9/2008 |
| WO | WO 09/098591 | A2 | 8/2009 |
| WO | WO 10/054198 | A3 | 5/2010 |

OTHER PUBLICATIONS

Philip Morris Records, Dept of Health,London Gazette,State Intelligence. N403; Permitted Additives to Tobacco Products Supplementary List, 1991, https://www.industrydocumentslibrary.ucsf.edu/tobacco/docs/qgby0090.*

Butelli, Eugenio, et al., "*Enrichment of Tomato Fruit With Health-Promoting Anthocyanins by Expression of Select Transcription Factors*", Nature Biotechnology, vol. 26, No. 11, (2008), pp. 1301-1308.

Nestor, T.B., et al., "*Role of Oxides of Nitrogen in Tobacco-Specific Nitrosamine Formation in Flue-Cured Tobacco*", Beiträge zur Tabakforschung International/Contributions to Tobacco Research, vol. 20, No. 7, (2003), pp. 467-475.

Roton, C. de, et al., "*Factors Influencing the Formation of Tobacco-Specific Nitrosamines in French Air-Cured Tobaccos in Trials and at the Farm Level*", Beiträge zur Tabakforschung International/Contributions to Tobacco Research, vol. 21, No. 6, (2005) pp. 305-320.

(56) References Cited

OTHER PUBLICATIONS

Staaf, M. et al., "*Formation of Tobacco-Specific Nitrosamines (TSNA) During Air-Curing: Conditions and Control*", Beiträge zur Tabakforschung International/Contributions to Tobacco Research, vol. 21, No. 6 (2005), pp. 321-330.
Wang, Li-Shu, et al., "*Anthocyanins and Their Role in Cancer Prevention*", Cancer Letters, vol. 269 (2008), pp. 281-290.
International Search Report to International Application No. PCT/US2009/051641, dated Mar. 19, 2010, 8p.
Written Opposition to corresponding Japanese Patent No. 6034824, dated May 30, 2017 and English translation (85p).
Encyclopedia of Tobacco, Tobacco Academic Studies Center and English Translation, (2009), (40p).
Davis, D. Layten, et al., "*Production Practices: Flue-cured Tobacco*,"Tobacco Production, Chemistry and Technology, (1999) and English translation, (22p).
Wong, M., "*Casings and Flavorings,*" https://www.industrydocumentslibrary.ucsf.edu/tobacco/docs/zgpf0016, dated Jul. 18, 1997 and English translation, (9p).
Leffingwell, John C., et al., "*Tobacco Flavoring for Smoking Products,*" R. J. Reynolds Tobacco Company 1972, (10p).
Voges, Ernst, Tobacco Encylopedia Tobbacco Journal International, (1984), (7p).
Ohba, Riichiroh, et al., "*Anthocyanins,*" Kenpakusha Co., Ltd. (2000) and English translation, (37p).
Cacao Pigment—Handbook of Natural Products 11$^{th}$ Edition, (1991) and English translation, (13p).

* cited by examiner

TOBACCO PRODUCTS AND PROCESSES

CROSS REFERENCE TO RELATED APPLICATION

This application claims priority to U.S. patent application Ser. No. 13/491,319, filed Jun. 7, 2012 and to U.S. patent application Ser. No. 12/267,061, filed Nov. 7, 2008, both of which incorporated in their entirety by reference herein.

FIELD OF THE INVENTION

The present invention relates to tobacco products, and in particular, to tobacco product formulations incorporating various ingredients.

BACKGROUND OF THE INVENTION

Tobacco has been enjoyed as a result of the use of smoking articles, such as cigarettes, cigars and pipes. Tobacco also has been enjoyed in a so-called "smokeless" form. Particularly popular smokeless tobacco products are employed by inserting some form of processed tobacco or tobacco-containing formulation into the mouth of the user.

Cigarettes generally have a substantially cylindrical rod shaped structure and include a charge, roll or column of smokable material, such as shredded tobacco (e.g., in cut filler form), surrounded by a paper wrapper, thereby forming a so-called "smokable rod" or "tobacco rod." Normally, a cigarette has a cylindrical filter element aligned in an end-to-end relationship with the tobacco rod. Typically, a filter element comprises cellulose acetate tow that is plasticized using triacetin, wherein the tow is circumscribed by a paper material known as "plug wrap." A cigarette can incorporate a filter element having multiple segments, and one of those segments can comprise activated charcoal particles. The filter element may be attached to one end of the tobacco rod using a circumscribing wrapping material known as "tipping paper," in order to provide a so-called "filtered cigarette." It also has become desirable, in some instances, to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999). The resulting cigarette is employed by a smoker by lighting one end thereof and burning the tobacco rod. The smoker then receives mainstream smoke into his/her mouth by drawing on the opposite end (e.g., the filter end) of the cigarette.

Various types of smokeless tobacco products are set forth in U.S. Pat. No. 1,376,586 to Schwartz; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,987,907 to Townsend; U.S. Pat. No. 5,092,352 to Sprinkle, III et al.; U.S. Pat. No. 5,387,416 to White et al.; and Des. 335,934 to Howard; U.S. Pat. Pub. Nos. 2005/0244521 to Strickland et al.; 2006/0162732 to Winn et al.; 2006/0191548 to Strickland et al., 2007/0261707 to Winterson et al., 2007/0062549 to Holton, Jr. et al.; 2007/0186941 to Holton, Jr. et al.; 2008/0156338 to Winterson et al.; and 2008/0166395 to Roush; PCT Pub. Nos. WO 04/095959 to Arnarp et al.; WO 05/063060 to Atchley et al.; WO 06/004480 to Engstrom; WO 05/041699 to Quinter et al.; and WO 07/138484 to Wrenn et al.; and U.S. patent application Ser. No. 11/781,604 to Dube et al.; each of which is incorporated herein by reference. One type of smokeless tobacco product is referred to as "snuff" Snuff typically is formulated in "moist" or "dry" forms.

Representative smokeless tobacco products have been marketed under the trade names Oliver Twist by House of Oliver Twist A/S; Copenhagen, Skoal, SkoalDry, Rooster, Red Seal, Husky, and Revel by U.S. Smokeless Tobacco Co.; "taboka" by Philip Morris USA; and Levi Garrett, Peachy, Taylor's Pride, Kodiak, Hawken Wintergreen, Grizzly, Dental, Kentucky King, Mammoth Cave by Conwood Sales Co., L.P., Interval by Brown & Williamson Tobacco Corp., and Ariva and Stonewall by Star Scientific, Inc.

Representative types of snuff products, commonly referred to as "snus," are manufactured in Europe, particularly in Sweden, by or through companies such as Swedish Match AB, Fiedler & Lundgren AB, Gustavus AB, Skandinavisk Tobakskompagni A/S and Rocker Production AB. Snus products available in the U.S.A. are marketed under the trade names Camel Snus Frost, Camel Snus Original and Camel Snus Spice by R. J. Reynolds Tobacco Company. Various types of packaging for those types of products are set forth in PCT Pub. Nos. WO 08/066450 and WO 08/066451, both to Sjöberg et al.; U.S. Pat. Pub. No. 2008/0173317 to Robinson et al.; and U.S. patent application Nos. 29/297,520 and 29/297,517, both to Patel et al.

It would be desirable to provide tobacco products incorporating components that provide enjoyment and satisfaction when employed by a user of those products.

SUMMARY OF THE INVENTION

The present invention relates to cured tobacco and processes for providing cured tobacco. Tobacco in green or yellow form can be cured by first placing that tobacco in intimate contact with at least one sugar and/or salt, and subjecting that tobacco to curing conditions. The resulting cured tobacco so provided can be used for the production of tobacco products, and in particular, smokeless tobacco products.

In one aspect, a method of curing tobacco comprises the steps of contacting a tobacco material with a curing additive comprising one or more salts and curing the tobacco material under conditions and temperature for a time sufficient to produce cured tobacco wherein the amount of the one or more salts contacted with the tobacco is at least 5 percent of the dry weight of the cured tobacco.

In a second aspect, a method of curing tobacco comprises the steps of contacting a tobacco material with a curing additive comprising one or more salts selected from the group consisting of sodium chloride and potassium chloride, curing the tobacco material under conditions and temperature for a time sufficient to produce cured tobacco, processing the cured tobacco to provide a processed tobacco material in a form suitable for incorporation into a smokeless tobacco product, and incorporating the processed tobacco material into a smokeless tobacco product.

BRIEF DESCRIPTION OF THE DRAWINGS

In order to provide an understanding of embodiments of the invention, reference is made to the appended drawings, in which reference numerals refer to components of described exemplary embodiments of the invention. The drawings are exemplary only, and should not be construed as limiting the invention.

DETAILED DESCRIPTION OF THE PREFERRED EMBODIMENTS

The present inventions now will be described more fully hereinafter with reference to the accompanying drawings. The inventions may be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural referents unless the context clearly dictates otherwise.

The tobacco product, or tobacco formulation, incorporates at least one anthocyanin and/or at least one derivative thereof (e.g., anthocyanin saccharides, such as the anthocyanin glucosides). Exemplary anthocyanin-type compounds include pelargonidin, peonidin, cyanidin, delphinidin and malvidin, and glycosides thereof (e.g., cyanidin 3 glucopyranoside and deplhinidin 3 glucopyranoside). Anthocyanin-type compounds can be obtained from natural sources, such as bilberry, blueberry, blackberry, raspberry, boysenberry, sweet cherry, hawthorne, cranberry and strawberry (e.g., as components of extracts obtained from those natural sources). Anthocyanin compounds, such as cyanidin 3 glucopyranoside and deplhinidin 3 glucopyranoside, are synthetically produced. Exemplary anthocyanin compositions have been available as MP865 from Biolink Group AS of Norway. See also, for example, Wang et al., Cancer Letters, 269 (2008) 281-290.

The tobacco product, or tobacco formulation can also incorporate the flowers of a tobacco plant, or the extracted essential oils or other chemicals from tobacco flowers. Representative chemicals that may be isolated from tobacco flowers are known by those skilled in the art, and are available in online databases such as Pherobase.com under the Genus *Nicotiana*. Naturally occurring, or artificially synthesized tobacco floral volatiles and other chemicals may be added to the tobacco or tobacco formulation in order to add flavor. Flowers may be processed and then added to the tobacco product or tobacco formulation in order to add flavor and/or texture. Extracted essential oils may also be added to add flavor.

Figure 1:
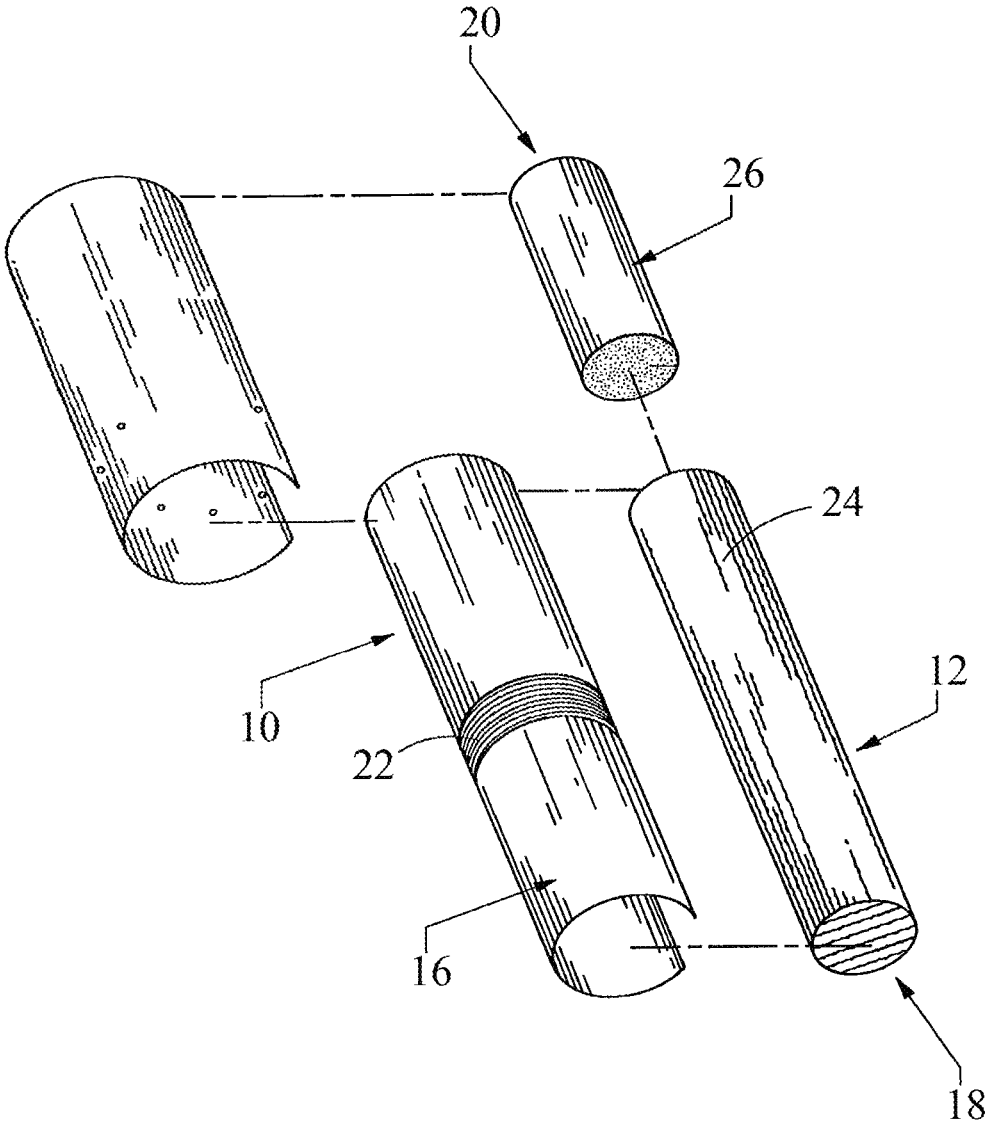
FIG. 1. is an exploded perspective view of a smoking article having the form of a cigarette.

Referring to FIG. 1, there is shown a smoking article 10 in the form of a cigarette and possessing certain representative components of a smoking article of the present invention. The cigarette 10 includes a generally cylindrical rod 12 of a charge or roll of smokable filler material 24 contained in a circumscribing wrapping material 16. The rod 12 is conventionally referred to as a "tobacco rod." The ends of the tobacco rod 12 are open to expose the smokable filler material. The cigarette 10 is shown as having one optional band 22 (e.g., a printed coating including a film-forming agent, such as starch, ethylcellulose, or sodium alginate) applied to the wrapping material 16, and that band 22 circumscribes the cigarette rod 12 in a direction transverse to the longitudinal axis of the cigarette 10. That is, the band 22 provides a cross-directional region relative to the longitudinal axis of the cigarette 10. The band 22 can be printed on the inner surface of the wrapping material (i.e., facing the smokable filler material), or less preferably, on the outer surface of the wrapping material. Although the cigarette can possess a wrapping material having one optional band, the cigarette also can possess wrapping material having further optional spaced bands numbering two, three, or more.

At one end of the tobacco rod 12 is the lighting end 18, and at the mouth end 20 is positioned a filter rod 26. The filter rod 26 is positioned adjacent one end of the tobacco rod 12 such that the filter rod 26 and tobacco rod 12 are axially aligned in an end-to-end relationship, preferably abutting one another. Filter rod 26 may have a generally cylindrical shape, and the diameter thereof may be essentially equal to the diameter of the tobacco rod. The ends of the filter rod 26 permit the passage of air and smoke therethrough. Various types of cigarette components, including tobacco types, tobacco blends, top dressing and casing materials, blend packing densities and types of paper wrapping materials for tobacco rods, can be employed; and various types of filter components or segments can be employed. See, for example, those smoking article components, and smoking article designs, formats, configurations and characteristics set forth and referenced in U.S. Pat. Pub. No. 2008/0029118 to Nelson et al., which is incorporated herein by reference.

Figure 2:
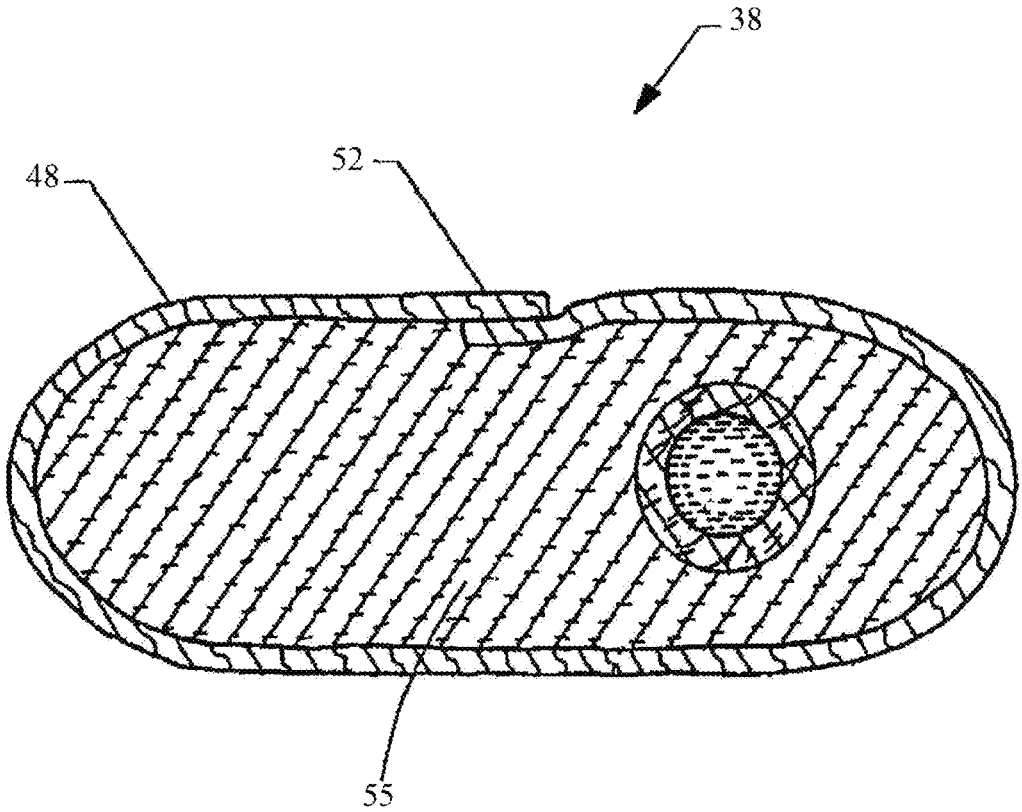
FIG. 2 is a cross-sectional view of a smokeless tobacco product in the form of a snus type of product.

Referring to FIG. 2, there is shown an embodiment of a smokeless tobacco product 38 that includes a moisture-permeable pouch 48. The pouch 48 is sealed along its length at an overlap region 52. The overlap region may be formed by sealing the bottom portion of one edge of the pouch 48 over the top portion of the opposite edge of the pouch (e.g., by heat sealing, suitable adhesive, or other suitable means). Exemplary fleece materials include BFF's SDH27 Natural Grade and BFF's SDH27 Brown. A solid tobacco material 55 is disposed within the pouch 48.

Suitable packets, pouches or containers of the type used for the manufacture of smokeless tobacco products are available under the trade names "taboka," CatchDry, Ettan, General, Granit, Goteborgs Rape, GrovSnus White, Metropol Kaktus, Mocca Anis, Mocca Mint, Mocca Wintergreen, Kicks, Probe, Prince, Skruf, TreAnkrare, Camel Snus Original, Camel Snus Frost and Camel Snus Spice. The tobacco formulation may be contained in pouches and packaged, in a manner and using the types of components used for the manufacture of conventional snus products. The pouch or fleece provides a liquid-permeable container of a type that may be considered to be similar in character to the mesh-like type of material that is used for the construction of a tea bag. Components of the loosely arranged, granular tobacco formulation readily diffuse through the pouch 78 and into the mouth of the user.

Descriptions of various components of snus products and components thereof also are set forth in U.S. Pat. Pub. No. 2004/0118422 to Lundin et al., which is incorporated herein by reference. See, also, for example, U.S. Pat. No. 4,607,479 to Linden; U.S. Pat. No. 4,631,899 to Nielsen; U.S. Pat. No. 5,346,734 to Wydick et al.; and U.S. Pat. No. 6,162,516 to Derr; and U.S. Pat. Pub. Nos. 2005/0061339 to Hansson et al. and Ser. No. 12/181,051 to Brinkley et al.; each of which is incorporated herein by reference. See, also, the representative types of pouches, and pouch material or fleece, set forth in U.S. Pat. No. 5,167,244 to Kjerstad, which is incorporated herein by reference. Snus products can be manufactured using equipment such as that available as SB 51-1/T, SBL 50 and SB 53-2/T from Merz Verpackungmaschinen GmbH. G.D SpA of Italy also supplies tobacco pouching equipment.

Other types or forms of smokeless tobacco products, and methods for their preparation, are set forth in U.S. Pat. No. 4,513,756 to Pittman et al. and U.S. Pat. No. 5,387,416 to White et al.; U.S. Pat. Pub. Nos. 2006/0191548 to Strickland et al. and 2008/0029110 to Dube et al.; and U.S. patent application Ser. No. 11/781,666 to Mua et al. and Ser. No. 12/181,051 to Brinkley et al.; each of which is incorporated herein by reference.

Tobaccos used for the manufacture of tobacco products can vary. The tobaccos may include types of tobaccos, such as flue-cured tobacco, burley tobacco, Oriental tobacco, Maryland tobacco, dark tobacco, dark-fired tobacco, dark air-cured and sun cured tobaccos, as well as the various *Nicotiana* species and *Rustica* tobaccos, as well as various rare or specialty tobaccos. Descriptions of various types of tobaccos, growing practices, harvesting practices and curing practices are set forth in *Tobacco Production, Chemistry and Technology*, Davis et al. (Eds.) (1999), which is incorporated herein by reference. See, also, the types of tobaccos that are set forth in U.S. Pat. No. 4,660,577 to Sensabaugh, Jr. et al.; U.S. Pat. No. 5,387,416 to White et al.; U.S. Pat. No. 6,730,832 to Dominguez et al.; and U.S. Pat. No. 7,025,066 to Lawson et al.; U.S. Pat. Pub. Nos. 2007/0062549 to Holton, Jr. et al. and 2007/0186941 to Holton, Jr. et al.; and U.S. patent application Ser. No. 11/781,666 to Mua et al. and Ser. No. 12/181,051 to Brinkley et al.; each of which is incorporated herein by reference. See, also, PCT WO 2007/089613 to Lawrence et al., which are incorporated herein by reference. Tobaccos can be employed in so-called "straight grade" form (e.g., as one tobacco type), or as blends of various amounts of different tobacco types.

The tobacco can be genetically altered, bred or cultivated. For example, tobaccos can be genetically altered, bred or cultivated to possess a relatively high level of at least one anthocyanin-type compound in any or all of the plant including, for example, the flowers, leaves, stems, stalks, roots or other portions. See, for example, the types of technologies set forth in U.S. Pat. No. 7,304,207 to Connors et al. and U.S. Pat. Pub. No. 2006/0242735 to Fader et al.; which are incorporated herein by reference. See also Butelli et al., Nature Biotechnology Advance Online Publication (26 Oct. 2008), doi: 10.1038/nbt.1506.

Most preferably, the tobacco materials are those that have been appropriately cured and aged. Descriptions of various types of curing and aging practices for various types of tobacco are set forth in *Tobacco Production, Chemistry and Technology*, Davis et al. (Eds.) (1999). For example, tobaccos can be flue-cured, air cured, sun cured and fire cured. Tobacco aging conditions and techniques will be apparent to those skilled in the art of tobacco product manufacture.

Especially preferred techniques and conditions for curing flue-cured tobacco are set forth in Nestor et al., Beitrage Tabakforsch. Int., 20 (2003) 467-475 and U.S. Pat. No. 6,895,974 to Peele, which are incorporated herein by reference. Representative techniques and conditions for air curing tobacco are set forth in Roton et al., Beitrage Tabakforsch. Int., 21 (2005) 305-320 and Staaf et al., Beitrage Tabakforsch. Int., 21 (2005) 321-330, which are incorporated herein by reference. See, also U.S. Pat. No. 6,834,654 to Williams.

One type of tobacco curing technique involves employment of so-called "sugar curing" methodologies. Tobacco is harvested in a so-called green or yellowed form. For example, Virginia tobacco leaf or and Burley tobacco stalks possessing leaves can be removed from the stalk using traditional harvesting techniques. The harvested tobacco may be in green or yellow form and may be individual leaf (including stem), or stemmed lamina Green tobacco can be characterized as tobacco having a form such that cells within that harvested plant or plant portion have not experienced significant or substantial cell death, and cellular respiration is capable of occurring to some degree. If desired, though not necessary and not preferable, the tobacco can be cured to some degree using conventional curing techniques before sugar curing.

The harvested tobacco then is subjected to sugar curing techniques, rather than traditional air curing, flue-curing, sun curing or fire curing techniques. The time period between harvest and commencement of sugar curing can vary, but typically is a time period comparable to that time period between harvest and traditional air curing, flue-curing, sun curing or fire curing techniques. The tobacco is introduced into a suitable container, vessel or other suitable means for holding the tobacco during the curing process. For example, the tobacco can be placed within a bin constructed from wooden slats or wire mesh to facilitate flow of air and removal of moisture from the tobacco. Alternatively, the tobacco can be contained in a sealed container to which negative pressure may be applied to facilitate removal of moisture from the tobacco. Tobacco can be tightly packed or compressed, loosely packed, or positioned so as to allow for movement or agitation during curing conditions.

During positioning of the tobacco within the container, the tobacco is placed in intimate contact with an amount of sugar, or mixture of sugars, sufficient to facilitate curing of that tobacco. For example, crystalline sugar is sprinkled over the surface of the tobacco, a sugar syrup is applied over the tobacco, or a concentrated aqueous sugar solution (e.g., approximately equal weight parts of sugar and water) is sprayed onto the surface of the tobacco. The tobacco and the effective amount of sugar curing additive then is subjected to curing conditions.

Curing conditions can be ambient conditions or near ambient conditions of temperature, or conditions different from ambient. The tobacco may also be cooled during curing conditions. Preferably, the tobacco is heated during curing conditions (e.g., to temperatures that typically do not exceed about 200° F., often do not exceed about 160° F., and frequently do not exceed about 130° F.). Prior to curing, green or yellowed tobacco typically possesses a moisture content of greater than about 80 percent, by weight.

Curing conditions are carried out for a time sufficient to cause the moisture content of the green or yellow tobacco to drop to less than about 20 percent, frequently less than about 15 percent, and often less than about 10 percent, by weight. Although curing conditions can be less than about 120 days, and often less than about 100 days; typical curing conditions occur over at least about 7 days, usually at least about 20 days, frequently at least about 30 days, and often at least about 40 days. The timeframe for curing, and the curing conditions, are sufficient to adequately dehydrate the tobacco and yield a tobacco that can be characterized as cured. After curing is complete, the tobacco is removed from the curing container. The cured tobacco can be separated from certain residual amounts of curing additive that is in contact with the surface of the cured tobacco. The cured tobacco then can be aged or otherwise employed for the production of tobacco products.

Another type of tobacco curing technique involves employment of so-called "salt curing" methodologies. The harvested tobacco is subjected to salt curing techniques, rather than traditional air curing, flue-curing, sun curing or fire curing techniques. The time period between harvest and commencement of salt curing can vary, but typically is a time period comparable to that time period between harvest and traditional air curing, flue-curing, sun curing or fire curing techniques. The tobacco is introduced into a suitable container, vessel or other suitable means for holding the tobacco during the curing process. For example, the tobacco can be placed within a bin constructed from wooden slats or wire mesh to facilitate flow of air and removal of moisture from the tobacco. Alternatively, the tobacco can be contained in a sealed container to which negative pressure may be applied to facilitate removal of moisture from the tobacco. Tobacco can be tightly packed or compressed, loosely packed, or positioned so as to allow for movement or agitation during curing conditions.

During positioning of the tobacco within the container, the tobacco is placed in intimate contact with an amount of salt, or mixture of salts, sufficient to facilitate curing of that tobacco. For example, crystalline salt is sprinkled over the surface of the tobacco, or a concentrated aqueous salt solution (e.g., approximately equal weight parts of salt and water) is sprayed onto the surface of the tobacco. The tobacco and the effective amount of salt curing additive then is subjected to curing conditions.

Curing conditions can be ambient conditions or near ambient conditions of temperature, or conditions different from ambient. The tobacco may also be cooled during curing conditions. Preferably, the tobacco is heated during curing conditions (e.g., to temperatures that typically do not exceed about 200° F., often do not exceed about 160° F., and frequently do not exceed about 130° F.). Prior to curing, green or yellowed tobacco typically possesses a moisture content of greater than about 80 percent, by weight.

Curing conditions are carried out for a time sufficient to cause the moisture content of the green or yellow tobacco to drop to less than about 20 percent, frequently less than about 15 percent, and often less than about 10 percent, by weight. Although curing conditions can be less than about 120 days, and often less than about 100 days; typical curing conditions occur over at least about 7 days, usually at least about 20 days, frequently at least about 30 days, and often at least about 40 days. The timeframe for curing, and the curing conditions, are sufficient to adequately dehydrate the tobacco and yield a tobacco that can be characterized as cured. After curing is complete, the tobacco is removed from the curing container. The cured tobacco can be separated from certain residual amounts of curing additive that is in contact with the surface of the cured tobacco. The cured tobacco then can be aged or otherwise employed for the production of tobacco products.

The sugar for sugar curing can be employed in powdered or crystalline form, in the form of a syrup (e.g., high fructose corn syrup), or within an aqueous solution. The sugar can be a so-called reducing sugar or a non-reducing sugar. Exemplary preferred sugars include sucrose, fructose and glucose; and other sugars include rhamnose, xylose and maltose. Mixtures of sugars can be used, or a relatively pure form of one sugar (e.g., crystalline sucrose) may be used.

The salt for salt curing can be employed in powdered or crystalline form, or within an aqueous solution. Exemplary preferred salts include sodium chloride, potassium chloride, sodium carbonate, sodium bicarbonate, potassium carbonate, potassium bicarbonate and ammonium chloride. Mixtures of salts can be used, or a relatively pure form of one salt (e.g., only sodium chloride) may be used.

Mixtures of salts and sugars can be used in the foregoing sugar and salt curing processes. The amount of salt (or mixture of salts) can range from more than to less than the amount of sugar (or mixture of sugars) in the salt and sugar curing additive mixture. For example, the curing formulation can comprise about 9 weight parts salt to 1 weight part sugar, 3 weight parts salt to 1 weight part sugar, 1 weight part salt to 1 weight part sugar, 1 weight part salt to 3 weight parts sugar, or 1 weight part salt to 9 weight parts sugar. An exemplary curing additive can be provided by combining sodium chloride with sucrose, and the resulting mixture can be employed as a solid, crystalline mixture or within an aqueous solution. Alternatively, for example, potassium chloride can be combined with high fructose corn syrup to from a curing additive.

The amount of curing additive that is employed can vary. Typically, the amount of curing additive that is employed is at least about 5 percent, often at least about 10 percent, based on the dry weight of the cured tobacco. Typically, the amount of curing additive that is employed does not exceed about 20 percent, and often does not exceed about 10 percent, of the total weight of the green or yellowed tobacco prior to commencement of curing. The amount of curing additive is preferably sufficient so as to affect the chemical nature of the tobacco during the curing process. The amount of curing additive also preferably assists in controlling the dehydration of the tobacco during the curing process.

Tobacco also can be subjected to a frying process. Tobacco is harvested in a so-called green or yellowed form. For example, Virginia tobacco leaf or and Burley tobacco stalks possessing leaves can be removed from the stalk using traditional harvesting techniques. The harvested tobacco may be in green or yellow form and may be individual leaf (including stem), or stemmed lamina Green tobacco can be characterized as tobacco having a form such that cells within that harvested plant or plant portion have not experienced significant or substantial cell death, and cellular respiration is capable of occurring to some degree. If desired, the harvested tobacco can be freeze dried, flash dried, or otherwise frozen. Alternatively, the tobacco can be cured. The tobacco is then subjected to frying techniques. The tobacco is placed (e.g., submerged) into hot oil, preferably using conventional types of frying devices and frying conditions. Exemplary oils are preferably oils such as canola, safflower, coconut, peanut, sunflower and other vegetable derived oils. Frying is carried out for a period of time sufficient to dehydrate the tobacco, most preferably without overly drying, charring or burning that tobacco. Frying temperatures typically are comparable to those employed during the frying of vegetables, such as potatoes, spinach, zucchini, or the like. The fried tobacco can separated from a residual amount of oil that is in contact with the surface of the fried tobacco. The fried tobacco can then be aged or otherwise employed for the production of tobacco products. Stalks or flowers may also be subjected to the frying process and then later incorporated into tobacco products.

The tobacco used for the manufacture of the tobacco product preferably is provided in a shredded, ground, granulated, fine particulate or powder form. The tobacco can have the form of processed tobacco parts or pieces, cured and aged tobacco in essentially natural lamina or stem form, a tobacco extract, extracted tobacco pulp (e.g., using water as a solvent), or a mixture of the foregoing (e.g., a mixture that combines extracted tobacco pulp with granulated cured and aged natural tobacco lamina).

The tobacco used for the manufacture of the tobacco product also can be processed, blended, formulated, combined and mixed with other materials or ingredients. For example, the tobacco composition can incorporate salts, sweeteners, binders, colorants, pH adjusters or buffers, fillers, flavoring agents, disintegration aids, antioxidants, humectants, and preservatives. See, for example, those representative components, combination of components, relative amounts of those components and ingredients relative to tobacco, and manners and methods for employing those components, set forth in U.S. Pat. Pub. Nos. 2007/0062549 to Holton, Jr. et al.; 2007/0186941 to Holton, Jr. et al.; and 2008/0029110 to Dube et al.; and U.S. patent application Ser. No. 11/781,666 to Mua et al. and Ser. No. 12/181,051 to Brinkley et al.; each of which is incorporated herein by reference.

Typically, for certain embodiments, the amount of tobacco material within a portion of an individual portion of a smokeless tobacco can be, on a dry weight basis, at least about 10 mg, often at least about 40 mg, and frequently at least about 40 mg; while that amount typically is less than about 200 mg, often less than about 150 mg, and frequently less than about 100 mg.

Typically, for certain other embodiments, the amount of tobacco material within a portion of an individual portion of a smokeless tobacco can be, on a dry weight basis, at least about 100 mg, often at least about 150 mg, and frequently at least about 200 mg; while that amount typically is less than about 800 mg, often less than about 700 mg, and frequently less than about 600 mg.

The amount of anthocyanin-type compound incorporated within the tobacco product or tobacco formulation can vary. The amount of anthocyanin-type compound preferably can be such that the user of tobacco product incorporating anthocyanin-type compound is exposed to less than about 1000 mg, frequently less than about 500 mg, often less than about 300 mg or even less than about 200 mg of anthocyanin-type compound as a result of tobacco product usage during a 24 hour period.

The amount of anthocyanin-type compound preferably can be such that the user of tobacco product incorporating anthocyanin-type compound is exposed to at least about 0.5 mg, frequently at least about 1 mg, often at least about 5 mg or even at least about 10 mg of anthocyanin-type compound in each portion of tobacco product that the tobacco user employs (e.g., within each snus pouch, each compressed tobacco pellet, each reconstituted tobacco sheet or strip, or each extruded tobacco stick; or transferred within the mainstream smoke delivered by a smokable).

The amount of anthocyanin-type compound preferably can be such that the smokeless tobacco product incorporating anthocyanin-type compound possesses at least about 1 percent, frequently at least about 5 percent, often at least about 10 percent, and even at least about 20 percent of anthocyanin-type compound, based on the dry weight of the tobacco within the tobacco formulation.

The anthocyanin-type compound can be incorporated into the tobacco product or tobacco formulation in a variety of ways. The anthocyanin-type compound can be endogenous to components of the tobacco formulation, and can be endogenous to the tobacco that is present within that formulation; the anthocyanin-type compound can be exogenous to the tobacco formulation (i.e., anthocyanin-type compound can be added to the tobacco formulation. Anthocyanin-type compounds can be applied to tobacco by spraying techniques or within casing or top dressing formulations. Anthocyanin-type compounds can be encapsulated, incorporated within reconstituted tobaccos, or otherwise incorporated within tobacco compositions. Anthocyanin-type compounds can be incorporated within or applied to papers, filter materials, breakable capsules, snus fleece, or other tobacco product components. Techniques for incorporating exogenous anthocyanin-type components within tobacco products will be readily apparent to those skilled in the art of tobacco product manufacture. If the anthocyanin-type compound is added to the tobacco itself, a representative amount of the added anthocyanin-type compound is at least about 1 percent to 3 percent of the total dry weight of the tobacco, often about 3 percent to 5 percent of the dry weight of the tobacco, and frequently at least 5 percent of the dry weight of the tobacco.

The moisture content of the smokeless tobacco formulation prior to use by a consumer of the formulation may vary. Typically, the moisture content of the tobacco formulation prior to insertion into the mouth of the tobacco user, is less than about 55 percent, generally is less than about 50 percent, and often is less than about 45 percent, based on the total weight of the tobacco formulation. For certain tobacco products, such as those incorporating moist snuff or snus-type tobacco compositions, the moisture content can exceed 20 weight percent, and often can exceed 30 weight percent; and typical snus-type tobacco compositions can have moisture contents of about 25 weight percent to about 50 weight percent, and often about 25 weight percent to about 40 weight percent. However, certain types of tobacco formulations have moisture contents, prior to use, of less than about 15 percent, frequently less than about 10 percent, and often less than about 5 percent, based on the total weight of the tobacco formulation. For certain tobacco products, such as compressed or extruded tobacco formulations, the moisture contents can range from about 5 weight percent to about 20 weight percent, and often about 8 weight percent to about 15 weight percent.

The acid or base content of a tobacco formulation gives it the ability to produce a pH. In the present application, "the pH of the tobacco" refers to the ability of the tobacco to produce a certain pH level. The pH of a preferred smokeless tobacco formulation can vary. Typically, the pH of that formulation is at least about 6.5, and preferably at least about 7.5. Typically, the pH of that formulation will not exceed about 9, and often will not exceed about 8.5. A representative tobacco formulation exhibits a pH of about 6.8 to about 8.2. A representative technique for determining the pH of a tobacco formulation involves dispersing 2 g of that formulation in 10 ml of high performance liquid chromatography water, and measuring the pH of the resulting suspension/solution (e.g., with a pH meter). Various buffering compounds and formulations for altering the acid or base content of tobacco are set forth in U.S. patent application Ser. No. 12/181,051 to Brinkley et al. For example, exemplary buffering compounds include potassium hydroxide, sodium hydroxide, sodium carbonate, potassium carbonate, potassium bicarbonate, sodium bicarbonate and ammonium bicarbonate.

If desired, prior to preparation of a smokeless tobacco formulation, the tobacco parts or pieces may be irradiated, or those parts and pieces may be pasteurized, or otherwise subjected to controlled heat treatment. Additionally, if desired, after preparation of all or a portion of the formulation, the component materials may be irradiated, or those component materials may be pasteurized, or otherwise subjected to controlled heat treatment. For example, a formulation may be prepared, followed by irradiation or pasteurization, and then flavoring ingredient(s) may be applied to the formulation. Alternatively, the tobacco formulation can be irradiated or pasteurized after the tobacco formulation has been formed or shaped (e.g., so as to form compressed pellets, extruded sticks or strips, or formed into a sheet-like shape), or incorporated within a moisture-permeable packet or pouch (e.g., so as to provide individual containers of snus-type smokeless tobacco product.

Typically, the amount of tobacco formulation within each individual portion (e.g., within each snus-type pouch) is such that there is at least about 50 mg, often at least about 150 mg, and frequently at least about 250 mg, of dry weigh tobacco; and less than about 700 mg, often less than about 500 mg, and frequently less than about 300 mg, of dry weight tobacco. For example, snus-type smokeless tobacco products can have the form of so-called "portion snus."

Typically, the amount of tobacco formulation within each individual portion (e.g., within each compressed tobacco pellet, extruded stick or formed sheet or strip) is such that there is at least about 10 mg, often at least about 20 mg, and frequently at least about 30 mg, of dry weigh tobacco; and less than about 200 mg, often less than about 150 mg, and frequently less than about 100 mg, of dry weight tobacco.

It should be noted that there could be a wide range of changes made to the present embodiments without departing from the scope of the claimed invention. It is therefore intended that the foregoing detailed description be regarded as illustrative rather than limiting, and that it be understood that it is the following claims, including all equivalents, that are intended to define the spirit and scope of this invention.

What is claimed is:

1. A method, comprising:

providing a tobacco material;

contacting the tobacco material with a curing additive comprising both one or more salts and one or more sugars, and curing the tobacco material under conditions of temperature and for a time sufficient to produce cured tobacco, wherein the amount of the curing additive contacted with the tobacco material is at least about 5 percent of the dry weight of the cured tobacco, wherein the curing step comprises air curing, flue curing, sun curing, or fire curing.

2. The method of claim 1, wherein the tobacco material is a harvested tobacco material.

3. The method of claim 1, wherein the one or more salts are selected from the group consisting of sodium chloride and potassium chloride.

4. The method of claim 1, wherein the curing additive is in powdered or crystalline form, or in the form of an aqueous salt solution.

5. The method of claim 1, wherein the contacting step comprises spraying the curing additive onto the tobacco material.

6. The method of claim 1, wherein the amount of the curing additive contacted with the tobacco material is at least about 10 percent of the dry weight of the cured tobacco.

7. The method of claim 1, wherein the amount of the curing additive contacted with the tobacco material is less than about 20 percent of the total weight of the tobacco material prior to curing.

8. The method of claim 1, wherein the amount of the curing additive contacted with the tobacco material is less than about 10 percent of the total weight of the tobacco material prior to curing.

9. The method of claim 1, wherein the curing additive is present in an aqueous solution comprising approximately equal weight parts of salt and water.

10. The method of claim 1, wherein the one or more salts are selected from the group consisting of sodium chloride and potassium chloride, and the amount of the one or more salts contacted with the tobacco material is at least about 10 percent of the dry weight of the cured tobacco.

11. The method of claim 1, further comprising:

processing the cured tobacco to provide a processed tobacco material in a form suitable for incorporation into a tobacco product; and incorporating the processed tobacco material into a smokeless tobacco product or a smoking article.

12. The method of claim 11, wherein the processed tobacco material is in shredded, ground, granulated, fine particulate, or powder form.

13. The method of claim 11, wherein the processed tobacco material is incorporated into a smokeless tobacco product.

14. The method of claim 13, wherein the smokeless tobacco product is snuff.

15. The method of claim 11, wherein the one or more salts is selected from the group consisting of sodium chloride and potassium chloride.

16. The method of claim 15, wherein the curing additive is in powdered or crystalline form, or in the form of an aqueous salt solution.

17. The method of claim 15, wherein the contacting step comprises spraying the curing additive onto the tobacco material.

18. The method of claim 15, wherein the smokeless tobacco product is snuff.

19. The method of claim 15, wherein the tobacco material is a harvested tobacco material.

20. The method of claim 1, wherein the curing additive comprises sodium chloride and sucrose.

21. The method of claim 1, wherein the curing additive comprises potassium chloride and fructose.

* * * * *